US006653580B2

(12) United States Patent
Goers et al.

(10) Patent No.: US 6,653,580 B2
(45) Date of Patent: Nov. 25, 2003

(54) DEVICE FOR LOCKING A PLUGGABLE ELECTRICAL UNIT

(75) Inventors: Andreas Goers, Pattensen (DE); Helmut Michel, Hannover (DE); Reiner Bleil, Peine (DE)

(73) Assignee: ABB Patent GmbH, Mannheim (DE)

( * ) Notice: Subject to any disclaimer, the term of this patent is extended or adjusted under 35 U.S.C. 154(b) by 0 days.

(21) Appl. No.: 10/000,343

(22) Filed: Oct. 23, 2001

(65) Prior Publication Data

US 2002/0074217 A1 Jun. 20, 2002

(30) Foreign Application Priority Data

Oct. 24, 2000 (DE) ..... 10052622

(51) Int. Cl.[7] ..... H01R 33/96
(52) U.S. Cl. ..... 200/51.09; 200/51 R; 361/740
(58) Field of Search ..... 200/51.09, 51 R, 200/51.11, 51.05, 51.06, 50.28, 50.29, 43.04, 43.07, 43.08; 361/740, 754, 759, 798, 801

(56) References Cited

U.S. PATENT DOCUMENTS 4,119,818 A * 10/1978 Noschese ..... 200/50 AA
5,343,009 A * 8/1994 Araoka et al. ..... 200/322
5,373,133 A * 12/1994 Brockway et al. ..... 200/335
5,635,690 A * 6/1997 Knecht et al. ..... 200/51.09
6,381,146 B1 * 4/2002 Sevier ..... 361/754

* cited by examiner

*Primary Examiner*—Lincoln Donovan
*Assistant Examiner*—K. Lee
(74) *Attorney, Agent, or Firm*—Michael M. Rickin

(57) ABSTRACT

The invention relates to a device for locking a pluggable electrical unit in an enclosure of an electrical base unit, the pluggable electrical unit having at least one arresting element, which engages in a mating arresting element in the enclosure of the base unit in such a way that the physical removal of the pluggable electrical unit is prevented in the locked state. For the slot-dependent detection of the actuation of locking elements on the part of the base unit, it is proposed to arrange the arresting element (21) such that, in the rest position, it is concealed by a movable covering (24) in such a way that the arresting element (21) is only accessible once the covering (24) has been removed. The covering (24) is in operative connection with an electrical switching contact (25), each position of the covering (24) deviating from the rest position triggering the switching contact (25). The covering (24) can only be brought into the rest position in the locked state of the pluggable electrical unit (2). The terminals of the switching contact (25) are electrically connected to a signal processing means (12) in the base unit (1).

8 Claims, 1 Drawing Sheet

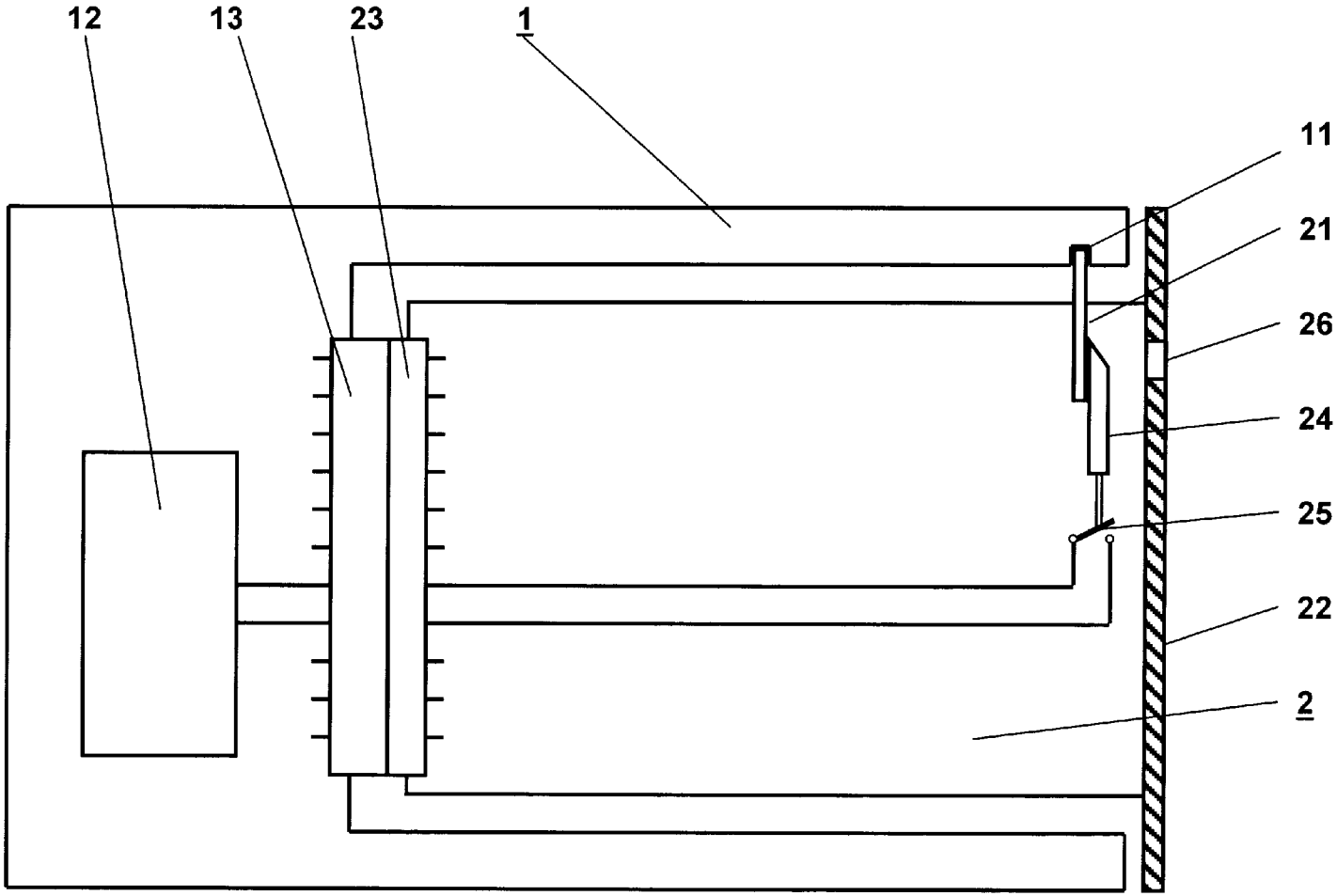
1
23
13
12
11
21
26
24
25
22
2

DEVICE FOR LOCKING A PLUGGABLE ELECTRICAL UNIT

DESCRIPTION

The invention relates to a device for locking a pluggable electrical unit in an enclosure of an electrical base unit.

Complex electrical engineering systems, in particular in measuring and control technology and in telecommunications, are often of a modular construction. This involves a large number of electrical units being accommodated in an enclosure of an electrical base unit in a pluggable manner.

In the simplest case, the pluggable electrical unit is fixed in the base unit only by the holding force of the plug-in connection. In addition, it is known from prior public use to screw the pluggable electrical unit to the base unit.

When a complex system of this type is expanded by adding further pluggable electrical units while operation is in progress or when one of the pluggable electrical units is exchanged, there is the risk of other electrical units being disrupted. Physically added pluggable electrical units are logically unknown to the base unit. Physically removed pluggable electrical units are still reported as present in the base unit. In particular, unit s equipped with microcomputing means require notice of the imminent change and a system-dependent minimum time to take into account the change in the physical composition of the modular system.

The invention is based on the object of specifying a device for locking a pluggable electrical unit in an enclosure of an electrical base unit, in which the actuation of locking elements can be detected on the part of the base unit slot-dependently.

According to the invention, this object is achieved by the means of Patent claim 1. Advantageous configurations of the invention are given in the dependent claims.

The invention is based on a device for locking a pluggable electrical unit in an enclosure of an electrical base unit, in which the pluggable electrical unit has at least one arresting element, which engages in a mating arresting element in the enclosure of the base unit in such a way that the physical removal of the pluggable electrical unit is prevented in the locked state.

The essence of the invention is to couple the mechanical locking of a pluggable electrical unit to the obligatory generation in advance of an electrical signal, the lead time being greater than the minimum time which the modular system requires for taking into account the change in the physical composition of the system.

To be specific, it is provided that the at least one arresting element is arranged such that, in the rest position, it is concealed by a movable covering in such a way that the arresting element is only accessible once the covering has been removed. The covering is in operative connection with an electrical switching contact, each position of the covering deviating from the rest position triggering the switching contact. The covering can only be brought into the rest position in the locked state of the pluggable electrical unit. The terminals of the switching contact are electrically connected to a signal processing means in the base unit.

When a pluggable electrical unit is added, once the pluggable electrical unit has been fully inserted, firstly the arresting element is locked and subsequently the covering is brought into the rest position. In this case, the switching contact is triggered and consequently signals the added unit to the signal processing means in the base unit.

For removing a plugged-in and arrested pluggable electrical unit, firstly the covering is brought out of the rest position. As this happens, the switching contact is triggered and consequently the unlocking and imminent removal of the pluggable electrical unit are signalled to the signal processing means in the base unit. Once the covering has been brought out of the rest position, the arresting element is accessible and is unlocked for the removal of the pluggable electrical unit. Then, the pluggable electrical unit is removed from the base unit.

If these measures are successful, a handling time in the range of several seconds from the actuation of the switching contact to the disconnection of the contacts of the plug-in contact device elapses when a pluggable electrical unit is removed. Given a minimal time which the modular system requires to take into account the change in the physical composition of the system, of the order of magnitude of a few hundred milliseconds, the system is reliably able to have taken all the required precautions before the corresponding pluggable electrical unit has been physically removed from the system.

In addition, it is ensured when adding a pluggable electrical unit that the system receives notice of the added unit and that this notice is only given once the unit has been mechanically locked in the system.

The invention is explained in more detail below on the basis of an exemplary embodiment. The single FIGURE required for this purpose shows a base unit 1 for receiving a plurality of pluggable electrical units 2. The enclosure of the base unit 1 has a mating arresting element 11. The mating arresting element 11 is configured as a recess aligned perpendicularly with respect to the direction of plugging movement.

The pluggable electrical unit 2 is equipped with a plug-in contact device 23 for the electrical connection of the pluggable electrical unit 2 to the base unit 1. The base unit 1 has a mating plug-in contact device 13 corresponding to the plug-in contact device 23. In addition, the base unit 1 is equipped with a signal processing means 12, which is connected to the mating plug-in contact device 13. The signal processing means 12 comprises a microcontroller with a processing unit, memory units and input/output unit s.

The pluggable electrical unit 2 is also equipped with an arresting element 21 corresponding to the mating arresting element 11 of the base unit. In the locked state of the pluggable electrical unit 2, the arresting element 21 engages in the mating arresting element 11 in such a way that removal of the pluggable electrical unit 2 from the base unit 1 is reliably prevented.

The arresting element 21 is arranged behind a front plate 22, represented in section, in the interior of the pluggable electrical unit 2 and can be operated through an opening 26 in the front plate 22. The arresting element 21 is covered by a covering 24, which is in operative connection with a switching contact 25 and is arranged movably between the arresting element 21 and the front plate 22. This avoids unintentional removal of the covering 24, and the associated bypassing of the signalling.

For receiving a plurality of pluggable electrical units 2, the base unit 1 is equipped with a plurality of slots, each of which is assigned a mating plug-in contact device 13. The signal processing means 12 of the base unit is separately connected to the mating plug-in contact devices 13 of all the slots. Consequently, every change in the physical composition of the system can be detected slot-dependently.

In a special configuration of the invention, a common tool is provided for moving the covering 24 out of the rest position and for actuating the arresting element 21. This advantageously facilitates the handling of the combined locking and signalling mechanism and secures it against unauthorized and unintentional manipulation.

In a further configuration of the invention, the arresting element 21 is arranged displaceably in the interior of the pluggable electrical unit 2. In this case, the arresting element 21 is movable perpendicularly with respect to the direction of plugging movement of the pluggable electrical unit 2.

In an alternative configuration of the invention, the arresting element 21 is arranged rotatably in the interior of the pluggable electrical unit 2. In this case, the arresting element 21 is movable on an axis of rotation parallel to the direction of plugging movement of the pluggable electrical unit 2.

In a further configuration of the invention, the covering 24 is arranged displaceably in the interior of the pluggable electrical unit 2. In this case, the covering 24 is movable perpendicularly with respect to the direction of plugging movement of the pluggable electrical unit 2.

In an alternative configuration of the invention, the covering 24 is arranged rotatably in the interior of the pluggable electrical unit 2. In this case, the covering 24 is movable on an axis of rotation parallel to the direction of plugging movement of the pluggable electrical unit 2.

In a further alternative configuration of the invention, the covering 24 is arranged pivotably in the interior of the pluggable electrical unit 2. In this case, the covering 24 is movable on a pivot axis perpendicular to the direction of plugging movement of the pluggable electrical unit 2.

When a pluggable electrical unit 2 is added, once the pluggable electrical unit 2 has been fully inserted, firstly the arresting element 21 is brought into engagement in the mating arresting element 11 of the base unit 1 and subsequently the covering 24 is brought into the rest position. As this happens, the switching contact 25 is triggered, and consequently the added unit 2 is signalled in a slot-related way to the signal processing means 12 in the base unit 1. Consequently, the base unit 1 is made aware of the added unit 2 logically as such and physically in a slot-specific manner. In response to this event, routines for commencing data exchange with the added unit 2 are initiated in the signal processing means 12.

For removing a plugged-in and arrested pluggable electrical unit 2, firstly the covering 24 is brought out of the rest position. As this happens, the switching contact 25 is triggered, and consequently the unlocking and imminent removal of the pluggable electrical unit 2 are signalled to the signal processing means 12 in the base unit 1. In response to this event, routines for the orderly ending of the data exchange with the unit 2 to be removed are initiated in the signal processing means 12. After their completion, the pluggable electrical unit 2 to be removed is logically removed from the system. The remaining rump system is unaffected by the subsequent physical removal of the pluggable electrical unit 2. Consequently, disruptions to the remaining rump system are avoided.

Once the covering 24 has been brought out of the rest position, the arresting element 21 is accessible and is unlocked for the removal of the pluggable electrical unit 2. Then, the pluggable electrical unit 2 is physically removed from the base unit 1.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. Device for locking a pluggable electrical unit in an enclosure of an electrical base unit, the pluggable electrical unit having a front plate, at least one arresting element, which engages in a mating arresting element in the enclosure of the base unit in such a way that the physical removal of the pluggable electrical unit is prevented in the locked state, characterized in that the arresting element is arranged such that, in the rest position, it is concealed by a movable covering in such a way that the arresting element is only accessible once the covering has been removed, said arresting element and said movable covering both residing in their entirety behind said front plate in the interior of said pluggable electrical unit and are accessible only through an opening in said front plate when said pluggable electrical unit is locked in said electrical base unit, in that the covering is in operative connection with an electrical switching contact that has terminals, in that each position of the covering deviating from the rest position triggers the switching contact, in that the covering can only be brought into the rest position in the locked state of the pluggable electrical unit and in that the terminals of the switching contact are electrically connected to a signal processing means in the base unit.

2. Device according to claim 1, characterized in that a common tool is provided for moving the covering out of the rest position and for actuating the arresting element.

3. The device of claim 1 wherein said arresting element is displaceable.

4. The device of claim 2 wherein said arresting element is displaceable.

5. The device of claim 1 wherein said covering is displaceable.

6. The device of claim 2 wherein said covering is displaceable.

7. Device for locking a pluggable electrical unit in an enclosure of an electrical base unit, the pluggable electrical unit having a front plate, at least one arresting element, which engages in a mating arresting element in the enclosure of the base unit in such a way that the physical removal of the pluggable electrical unit is prevented in the locked state, characterized in that the arresting element is arranged such that, in the rest position, it is concealed by a movable covering in such a way that the arresting element is only accessible once the covering has been removed, said removable covering arranged behind said front plate in the interior of said pluggable electrical unit and is accessible only through an opening in said front plate when said pluggable electrical unit is locked in said electrical base unit, in that the covering is in operative connection with an electrical switching contact that has terminals, in that each position of the covering deviating from the rest position triggers the switching contact, in that the covering can only be brought into the rest position in the locked state of the pluggable electrical unit and in that the terminals of the switching contact are electrically connected to a signal processing means in the base unit.

8. Device according to claim 7, characterized in that a common tool is provided for moving the covering out of the rest position and for actuating the arresting element.

* * * * *